US009241601B2

(12) United States Patent
Case et al.

(10) Patent No.: US 9,241,601 B2
(45) Date of Patent: Jan. 26, 2016

(54) ROLL HOLDER APPLIANCE USABLE WITH A DISPENSER

(75) Inventors: Abby C. Case, Green Bay, WI (US); Alexander Trampolski, Richmond (CA); Kathleen A. Jordan, Alpharetta, GA (US); Andrew Jackman, Langley, CA (US)

(73) Assignee: Georgia-Pacific Consumer Products LP, Atlanta, GA (US)

( * ) Notice: Subject to any disclaimer, the term of this patent is extended or adjusted under 35 U.S.C. 154(b) by 749 days.

(21) Appl. No.: 12/912,890

(22) Filed: Oct. 27, 2010

(65) Prior Publication Data

US 2011/0210198 A1 Sep. 1, 2011

Related U.S. Application Data

(60) Provisional application No. 61/258,883, filed on Nov. 6, 2009.

(51) Int. Cl.
*B65H 75/18* (2006.01)
*A47K 10/38* (2006.01)

(52) U.S. Cl.
CPC ..... *A47K 10/38* (2013.01)

(58) Field of Classification Search
CPC .... B65H 10/24; B65H 10/38; B65H 2511/12; B65H 2220/04; A47K 10/24; A47K 10/38
USPC ..... 242/596, 596.7, 597.5, 597.6, 599, 242/599.4
See application file for complete search history.

(56) References Cited

U.S. PATENT DOCUMENTS

| | | | | |
|---|---|---|---|---|
| 3,126,234 | A * | 3/1964 | Batlas et al. | 242/560 |
| 4,974,783 | A * | 12/1990 | Campbell | 242/596.7 |
| 6,183,153 | B1 * | 2/2001 | Kamoda et al. | 400/613 |
| 6,439,502 | B1 * | 8/2002 | Gemmell et al. | 242/596.3 |
| 6,503,008 | B2 * | 1/2003 | Zevin et al. | 400/613 |
| 6,695,500 | B2 * | 2/2004 | Kim et al. | 400/613 |
| 6,749,149 | B1 * | 6/2004 | Friesen | 242/596.7 |
| 6,877,920 | B2 * | 4/2005 | Fujioka | 400/613 |
| 2004/0104300 | A1 * | 6/2004 | Friesen | 242/596.7 |

* cited by examiner

*Primary Examiner* — William A Rivera
(74) *Attorney, Agent, or Firm* — Sutherland Asbill & Brennan LLP

(57) ABSTRACT

A dispenser suitable for dispensing a rolled product includes a housing having a back plate and a cover openably engaged with the back plate. Each of a pair of roll holder appliances disposed within the housing include a leg having a first end and a second end, and a first side and a second side. The first end has an attachment feature, and the second end has a first roll holder on the first side, and a second roll holder on the second side opposing and different from the first roll holder. The attachment feature of each appliance is removably attached to the back plate, each appliance being oriented with associated roll holders facing each other and suitably spaced apart so as to receive the rolled product therebetween.

11 Claims, 7 Drawing Sheets

ROLL HOLDER APPLIANCE USABLE WITH A DISPENSER

BACKGROUND OF THE INVENTION

The present disclosure relates generally to a roll holder for a dispenser, and particularly to a reversible roll holder appliance having opposing roll holders that accommodate different types and/or widths of rolls of product.

Sheet products are typically supplied on rolls that are loaded into sheet product dispensers for the purpose of dispensing sheets. The term "sheet products" or "roll of product" as used herein is inclusive of natural and/or synthetic cloth or paper sheets. Sheet products may include both woven and non-woven articles. There are a wide variety of nonwoven processes and they can be either wetlaid or drylaid. Some examples include hydroentagled (sometimes called spunlace), DRC (double re-creped), airlaid, spunbond, carded, paper towel, and meltblown sheet products. Further, sheet products may contain fibrous cellulosic materials that may be derived from natural sources, such as wood pulp fibers, as well as other fibrous material characterized by having hydroxyl groups attached to the polymer backbone. These include glass fibers and synthetic fibers modified with hydroxyl groups. Examples of sheet products include, but are not limited to, wipers, napkins, tissues, rolls, towels or other fibrous, film, polymer, or filamentary products.

In general, sheet products are thin in comparison to their length and breadth and exhibit a relatively flat planar configuration and are flexible to permit folding, rolling, stacking, and the like. The sheet product may have perforations extending in lines across its width to separate individual sheets and facilitate separation or tearing of individual sheets from the roll at discrete intervals. Individual sheets may be sized as desired to accommodate the many uses of the sheet products. For example, perforation lines may be formed every 13 inches to define a universally sized sheet. Multiple perforation lines may be provided to allow the user to select the size of sheet depending on the particular need.

Rolls of product may be supplied coreless or with a plug inserted in one or both ends to serve as a pivot, and my come in different widths, which makes reloading a full roll of sheet product into a sheet dispenser limited by the type of roll product originally used. As such, there is a need in the industry for improved dispenser configurations to accommodate different roll types and widths.

This background information is provided to reveal information believed by the applicant to be of possible relevance to the present invention. No admission is necessarily intended, nor should be construed, that any of the preceding information constitutes prior art against the present invention.

BRIEF DESCRIPTION OF THE INVENTION

An embodiment of the invention includes a roll holder appliance including a leg having a first end and a second end, and a first side and a second side. The first end has an attachment feature, and the second end has a first roll holder on the first side, and a second roll holder on the second side opposing and different from the first roll holder.

An embodiment of the invention includes a dispenser suitable for dispensing a rolled product. A housing includes a back plate and a cover openably engaged with the back plate. Each of a pair of roll holder appliances disposed within the housing include a leg having a first end and a second end, and a first side and a second side. The first end has an attachment feature, and the second end has a first roll holder on the first side, and a second roll holder on the second side opposing and different from the first roll holder. The attachment feature of each appliance is removably attached to the back plate, each appliance being oriented with associated roll holders facing each other and suitably spaced apart so as to receive the rolled product therebetween.

An embodiment of the invention includes a dispenser suitable for dispensing a rolled product. A housing includes a back plate and a cover openably engaged with the back plate. A pair of reversible and interchangeable roll holder appliances are removably attached to the back plate, each appliance being oriented with associated roll holders facing each other and suitably spaced apart so as to receive the rolled product therebetween.

An embodiment of the invention includes a product having any feature described herein, explicitly or equivalently, either individually or in combination with any other feature, in any configuration.

An embodiment of the invention includes a method of forming any of the above identified products, including any process or sub-process described herein, explicitly or equivalently, in any order, using any modality suitable for the purpose disclosed herein.

BRIEF DESCRIPTION OF THE DRAWINGS

Referring to the exemplary drawings wherein like elements are numbered alike in the accompanying Figures.

DETAILED DESCRIPTION OF THE INVENTION

Although the following detailed description contains many specifics for the purposes of illustration, anyone of ordinary skill in the art will appreciate that many variations and alterations to the following details are within the scope of the invention. Accordingly, the following preferred embodiments of the invention are set forth without any loss of generality to, and without imposing limitations upon, the claimed invention.

An embodiment of the invention, as shown and described by the various figures and accompanying text, provides a dispenser suitable for dispensing a rolled product such as paper towels for example, where the roll holder appliances (arms for holding the rolled product therebetween) are adapted, configured and dimensioned so as to be removable, reversible, and interchangeable with each other, thereby permitting rolls of different widths, coreless rolls, and rolls having an axial plug, to be used within the same dispenser. Example roll widths that may be usable with some embodiments of the invention include widths of 7-inches, 8-inches, 9-inches or 10-inches, with typical widths ranging from 7.75-inches and 8.25-inches. While embodiments described herein depict a paper towel dispenser as an example dispenser, it will be appreciated that the disclosed invention is also applicable to other types of roll dispensers, such as toilet paper dispensers for example.

Figure 1:
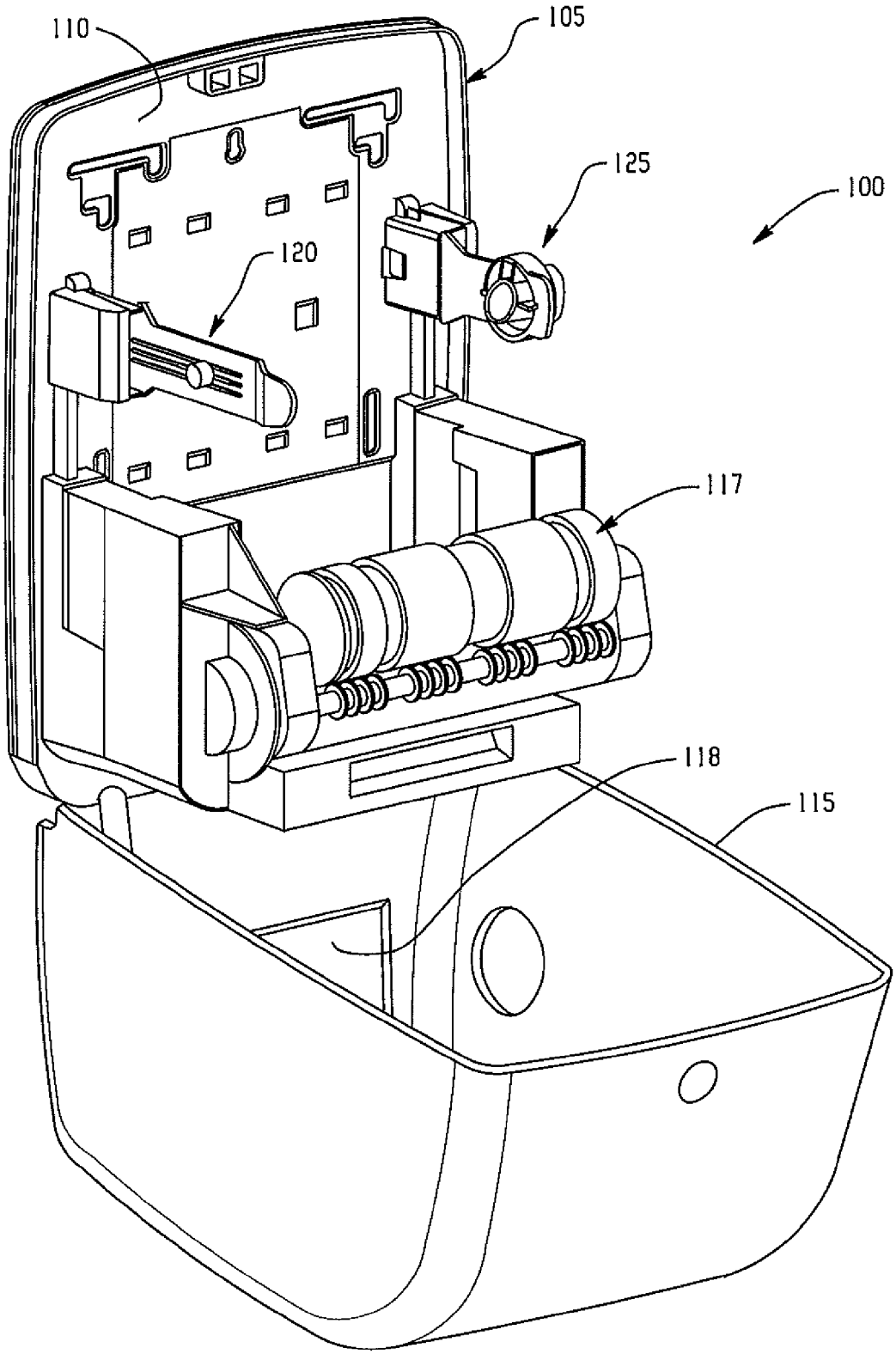
FIG. 1 depicts in isometric view an exemplary dispenser in accordance with an embodiment of the invention.
Figure 2:
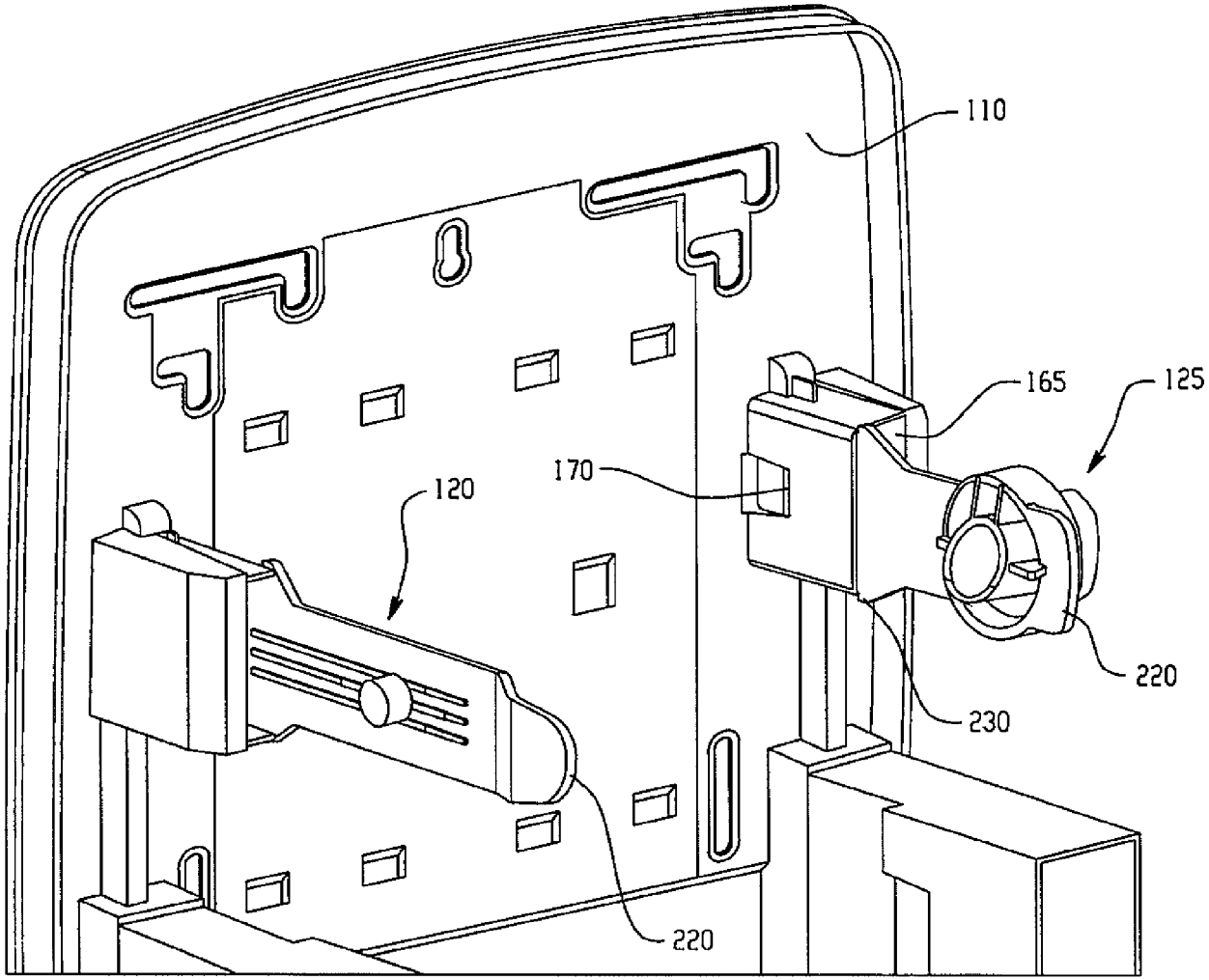
FIG. 2 depicts in isometric view a magnified view of a portion of the dispenser of FIG. 1.
Figure 3:
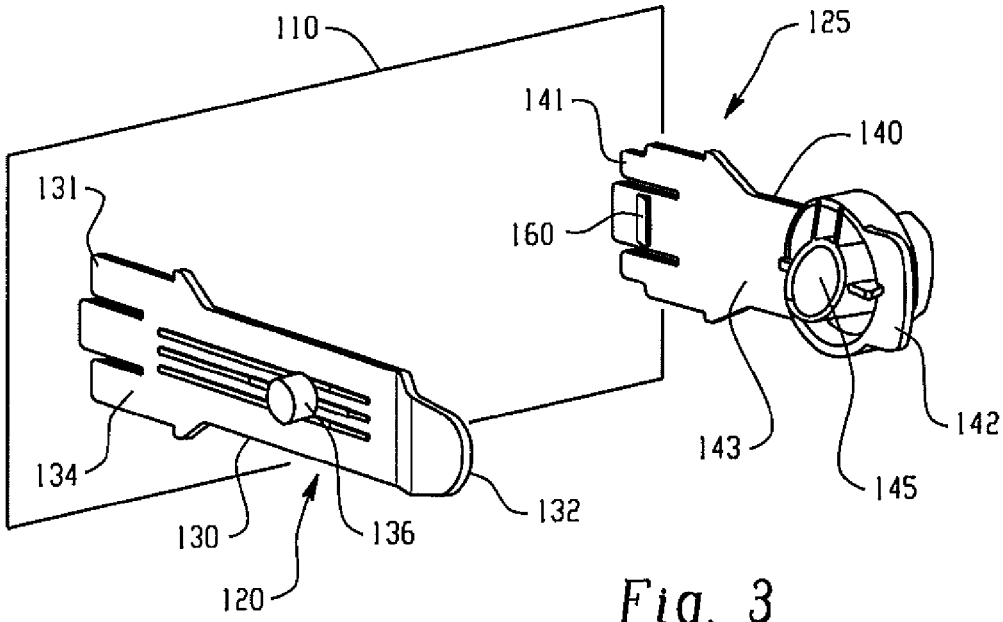
FIGS. 3 and 4 depict in isometric view the roll holder appliances depicted in FIGS. 1 and 2 in accordance with an embodiment of the invention.
Figure 4:
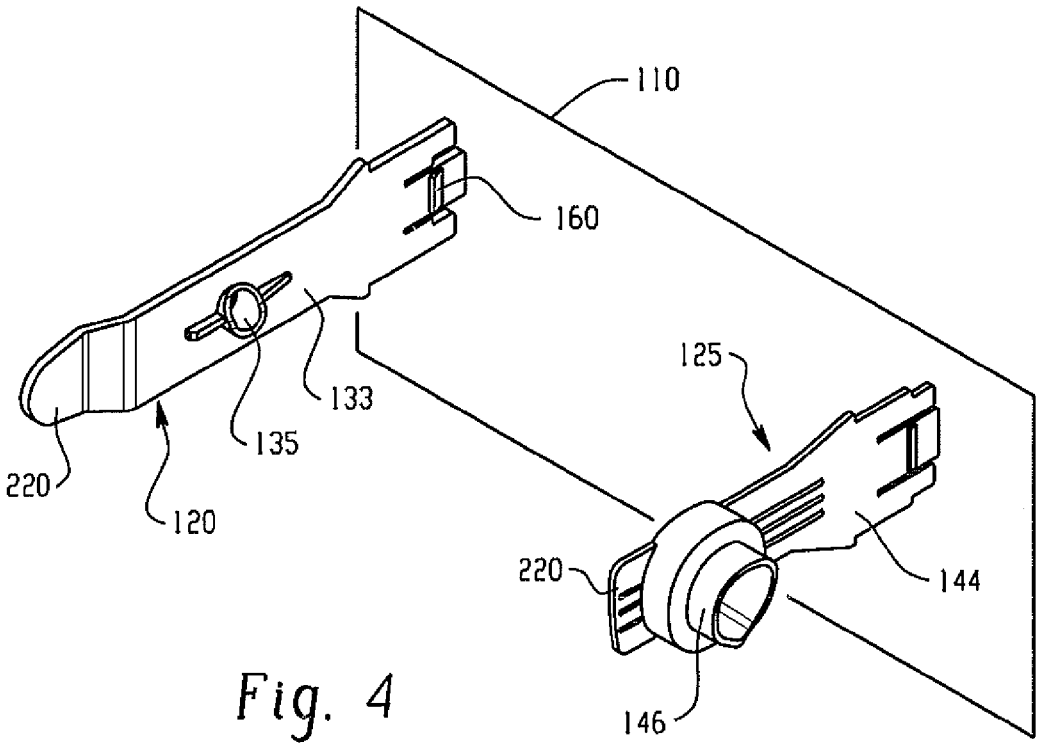
Figure 5D:
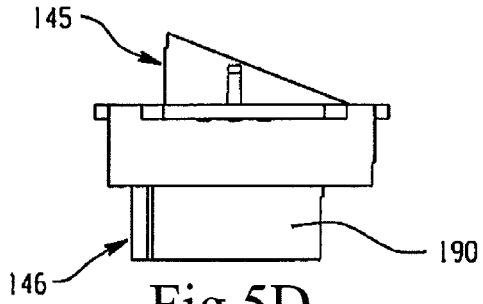
FIGS. 5 and 6 each depict four orthogonal views of example roll holder appliances in accordance with an embodiment of the invention.
Figure 5B:
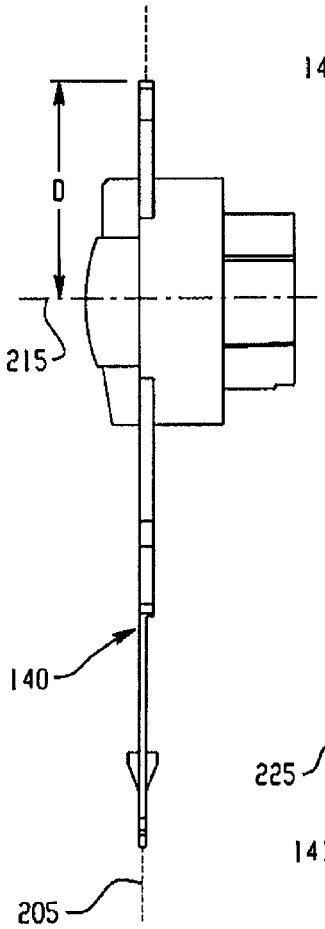
Figure 5A:
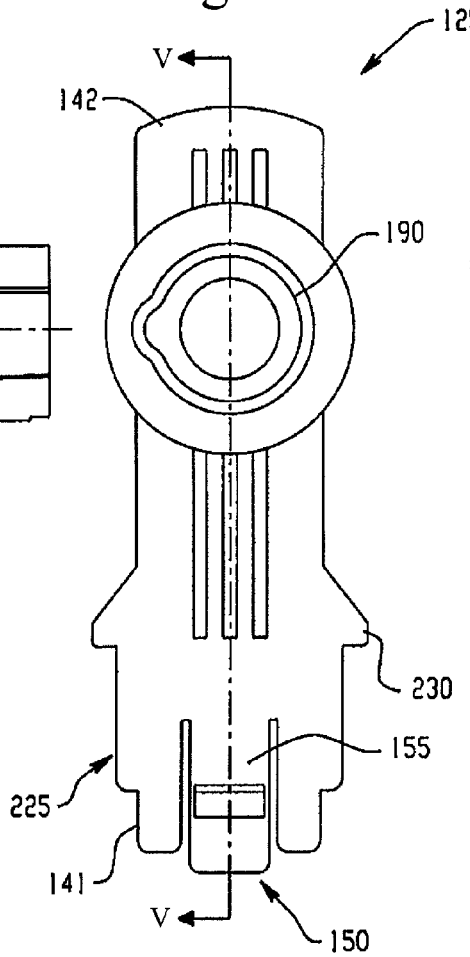
Figure 5C:
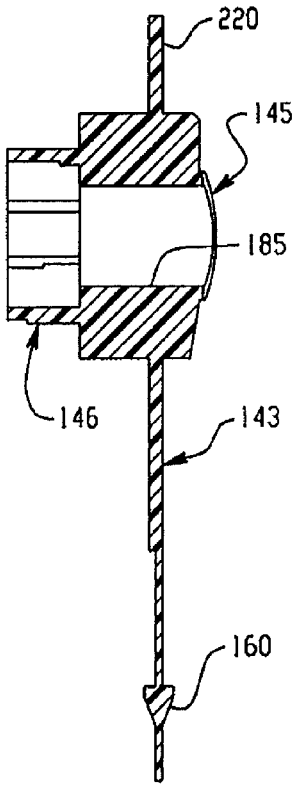
Figure 6D:
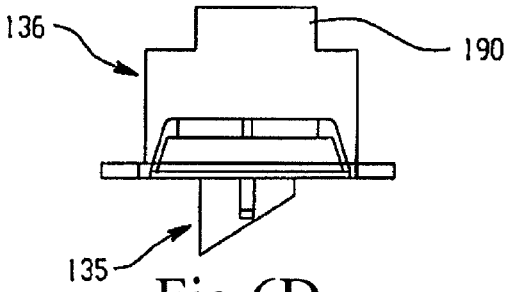
Figure 6B:
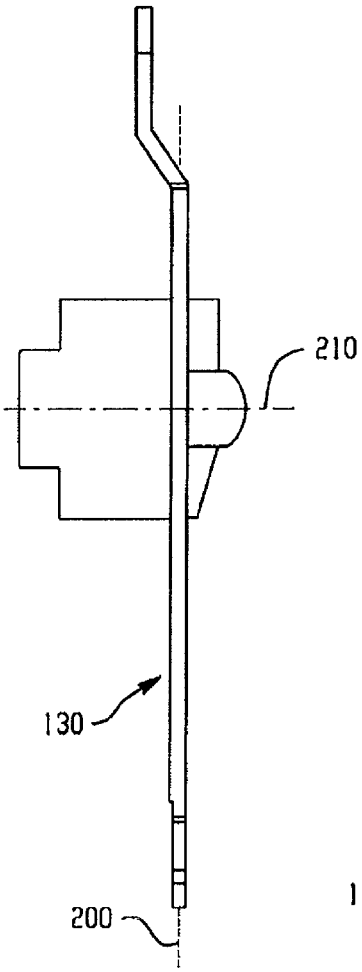
Figure 6A:
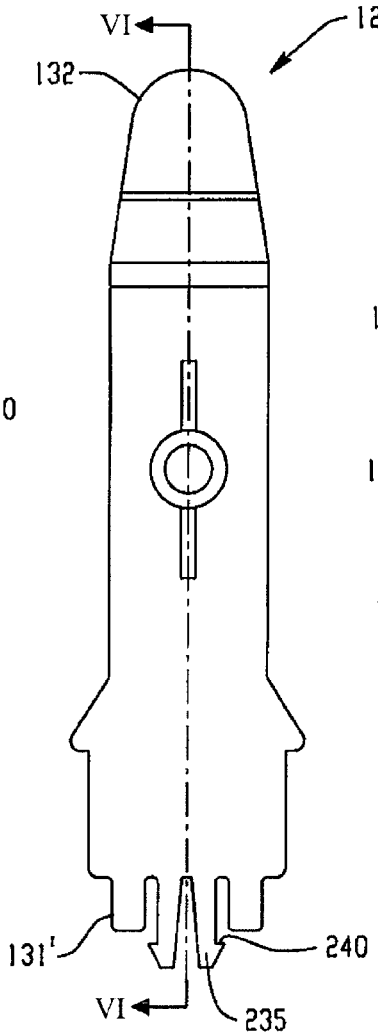
Figure 6C:
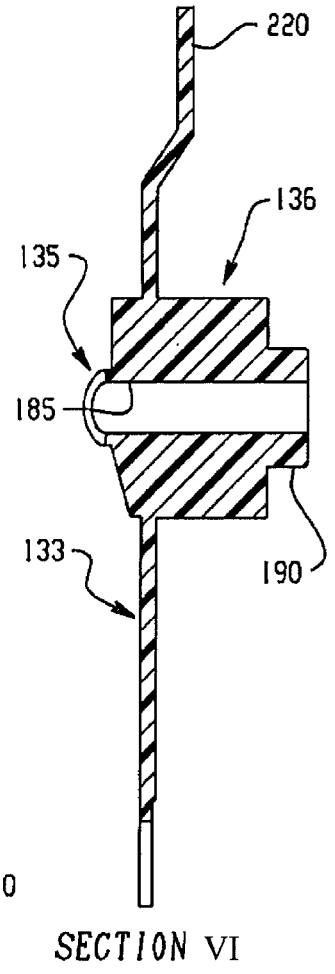
Figure 7:
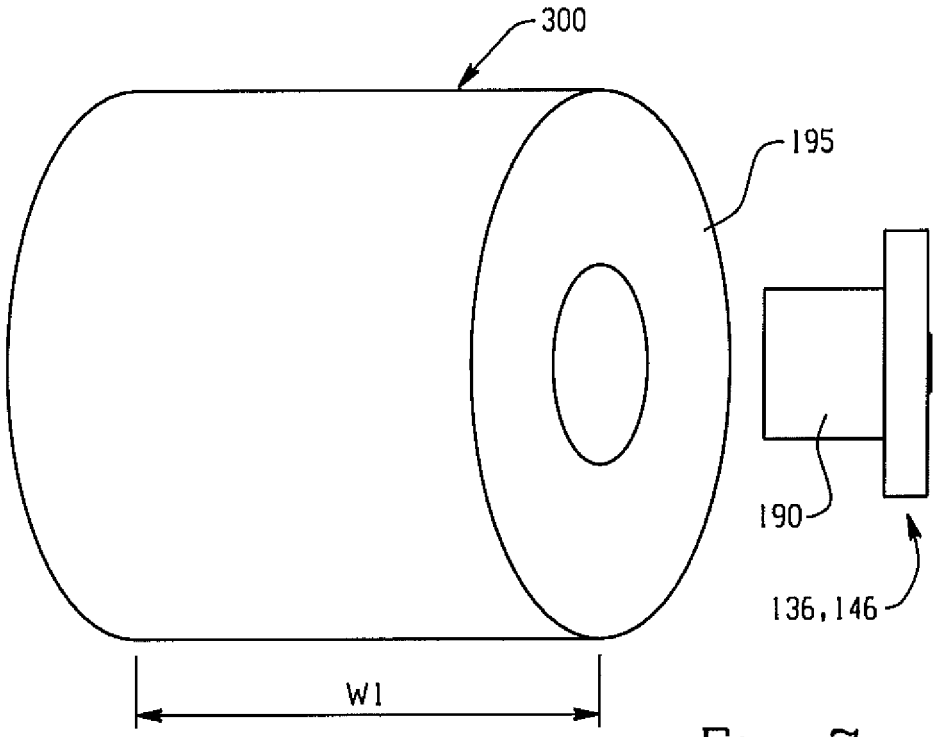
FIGS. 7 and 8 depict in isometric view example rolls of product for use in accordance with an embodiment of the invention.
Figure 8:
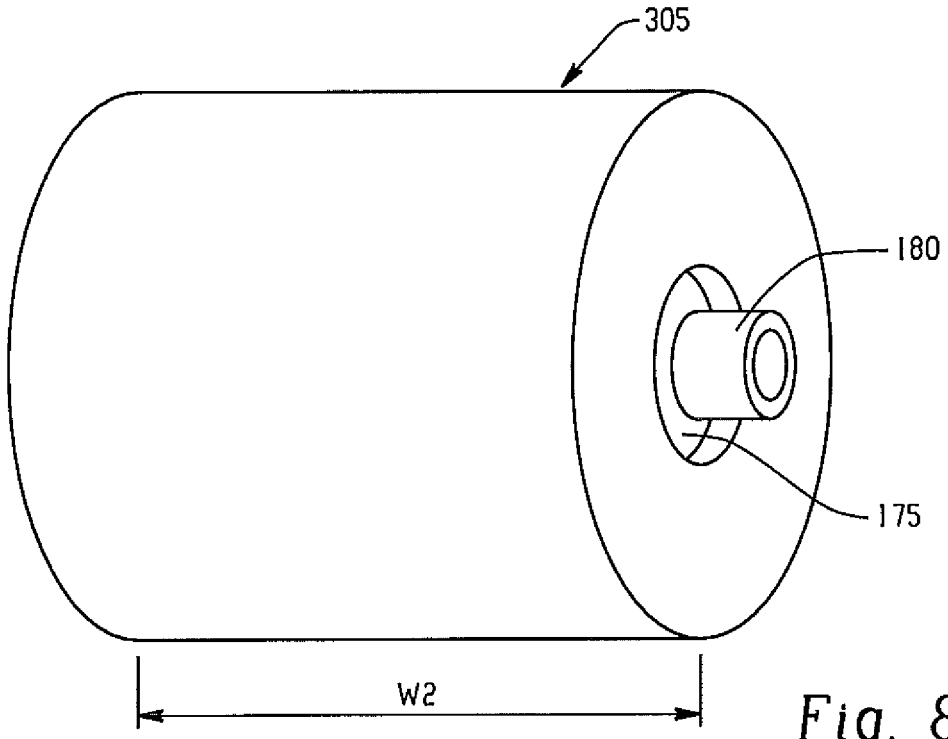

FIG. 1 is an example embodiment of a dispenser 100 suitable for dispensing a rolled product 300, 305 (best seen by referring to FIGS. 7 and 8) having a housing 105 comprising a back plate 110 and a cover 115 openably engaged with the back plate 110, and a dispensing mechanism 117 for dispensing sheets from a roll of product through aperture 118. In an embodiment, the roll of product is paper. A pair of roll holder appliances 120, 125 are removably attached to the back plate 110. The first and second roll holder appliances 120, 125 are depicted in FIG. 2 in a magnified view, in FIG. 3 from a left side perspective, in FIG. 4 from a right side perspective, and in FIGS. 5 and 6 in orthogonal side, top and bottom views. With reference to FIGS. 2-4, each appliance 120, 125 has a leg 130, 140 having a first end 131, 141 (attachment end towards back plate 110) and a second end 132, 142 (holder end away from back plate 110), and a first side 133, 143 (inside surface depicted in FIGS. 3 and 4) and a second side 134, 144 (outside surface depicted in FIGS. 3 and 4).

The second appliance 125 depicted in FIGS. 3-4 is depicted in the orthogonal drawing views of FIG. 5. The first appliance 120 depicted in FIGS. 3-4 is substantially depicted in the orthogonal drawing views of FIG. 6, but with an alternative first end 131' illustrated, which will be discussed in more detail below.

Referring now to FIGS. 2-6 in combination, the first end 131, 141 of each appliance 120, 125 includes an attachment feature 150 defined by a flexible leg 155 and a latch 160. Upon insertion of the attachment feature 150 into a slot 165 of back plate 110 (see FIG. 2), the flexible leg 155 deflects until the latch 160 engages with catch 170 of back plate 110, thereby providing a snap fit locking arrangement. Removal of appliances 120, 125 is achieved by disengaging latch 160 from catch 170, and pulling the appliance 120, 125 out of slot 165. In this manner, appliances 120, 125 are interchangeable with each other and can be inserted as shown in FIGS. 3-4 with first sides 133, 143 facing inwards, or rotated 180-degrees so that second sides 134, 144 face inwards.

The second end 132, 142 of each appliance 120, 125 includes a first roll holder 135, 145 on the respective first side 133, 143, and a second roll holder 136, 146 on the respective second side 134, 144 opposing the respective first roll holders 135, 145. From the various illustrations depicted in FIGS. 1-6, it will be appreciated that the first roll holders 135, 145 are different from the second roll holders 136, 146, that each of the first roll holders 135, 145 are different from each other, and that each of the second roll holders 136, 146 are different from each other, which will now be explained in further detail.

In the embodiments illustrated, first roll holders 135, 145 are configured to receive and support a roll of product 305 equipped with an axial plug 175 (best seen by referring to FIG. 8) having a spindle 180 that fits within an internal pivotal surface 185 of a respective first roll holder 135, 145. Second roll holders 136, 146 are configured to receive and support a coreless roll of product 300 that is not equipped with an axial plug, where an external pivotal surface 190 of a respective second roll holder 136, 146 fits within the open coreless end 195 of roll product 300. A typical arrangement is such that the external pivotal surface 190 has an outside diameter greater than an inside diameter of the internal pivotal surface 185.

As depicted in FIGS. 1-4, appliances 120, 125 are oriented with their associated roll holders (first roll holders 135, 145 in FIGS. 1-4) facing each other and suitably spaced apart so as to receive a roll of product 300, 305 therebetween. Since each appliance 120, 125 has two sides 133, 134 and 143, 144, respectively, with a first roll holder 135, 145 on the respective first side 133, 143, and a second roll holder 136, 146 on the respective second side 134, 144, it will be appreciated that various combinations of roll holders is possible by using the same or different appliances flipped one way or the other. The table below provides a listing of the various combinations of roll holders that may be installed on a back plate 110 facing each other in a dispenser 100, where:

A=first roll holder 135 of first appliance 120;
B=second roll holder 136 of first appliance 120;
C=first roll holder 145 of second appliance 125; and
D=second roll holder 146 of second appliance 125.

| Group | Roll Holder Combinations Facing Each Other | | Roll Of Product with Core or Plug End |
|---|---|---|---|
| I | A | A | Plug-Plug |
| II | A | B | Plug-Core |
| III | A | C | Plug-Plug |
| IV | A | D | Plug-Core |
| V | B | A | Core-Plug |
| VI | B | B | Core-Core |
| VII | B | C | Core-Plug |
| VIII | B | D | Core-Core |
| IX | C | A | Plug-Plug |
| X | C | B | Plug-Core |
| XI | C | C | Plug-Plug |
| XII | C | D | Plug-Core |
| XIII | D | A | Core-Plug |
| XIV | D | B | Core-Core |
| XV | D | C | Core-Plug |
| XVI | D | D | Core-Core |

As can be seen from the table above, if a roll of product is provided with core ends only (no plugs), then Groups VI (B-B), VIII (B-D), XIV (D-B) and XVI (D-D) would be used. Other combinations can be readily determined by reference to the table above. For example, if a roll of product is provided with plug ends then Groups I (A-A), III (A-C), IX (C-A) and XI (C-C) would be used, or if one of the plugs is removed then a "Plug-Core" group or a "Core-Plug" group could be used. As such, different combinations of appliances can be used for different rolls of product having different core/plug arrangements.

In addition, an embodiment of the first and second appliances 120, 125 are configured so as to accommodate rolls of product 300, 305 having different widths W (the width dimension being measured from one side of the roll to the other) by varying how far from a medial line 200, 205 the internal and external pivotal surfaces 185, 190 extend (see FIGS. 5 and 6 for example). As depicted in FIGS. 5 and 6, each leg 130, 140 defines the respective medial line 200, 205 that extends centrally from the respective first end 131, 141 to the respective second end 132, 142. Respective first and second roll holders that oppose each other (135, 136 and 145, 146) have a respective pivot axis 210, 215 that extends perpendicularly from the respective medial line 200, 205. To accommodate rolls of different widths, the respective external 190 and internal 185 pivotal surfaces extend from the associated medial line 200, 205 by predefined first and second distances so as to provide sufficient engagement length with rolls of product of different width. In an embodiment, the second predefined distance is different from the first predefined distance.

Figure 9:
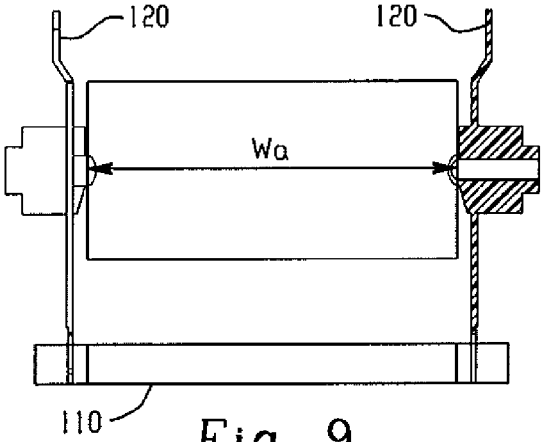
FIGS. 9-14 depict in block diagram view example arrangements of roll holder appliances in accordance with embodiments of the invention.
Figure 10:
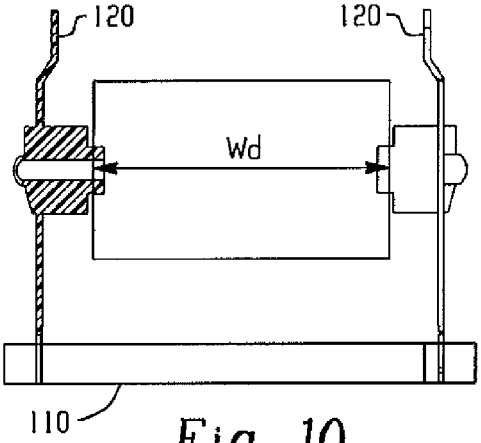
Figure 11:
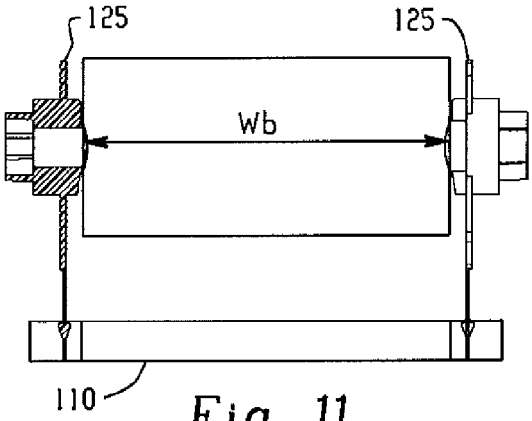
Figure 12:
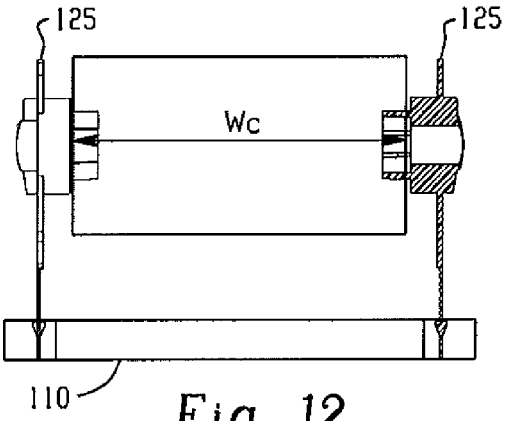
Figure 13:
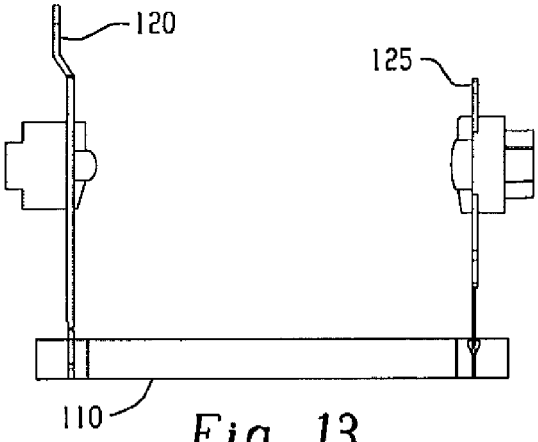
Figure 14:
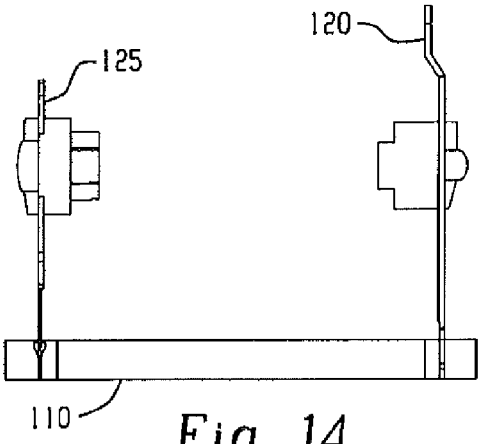

Examples of different combinations of appliances 120, 125 to accommodate different widths of rolls of product are illustrated in FIGS. 9-14, where each appliance 120, 125 is anchored to a commonly dimensioned back plate 110, and where width Wa>Wb>Wc>Wd. FIGS. 9 and 10 employ two first appliances 120, FIGS. 11 and 12 employ two second appliances 125, and FIGS. 13 and 14 employ combinations of first 120 and second 125 appliances. FIGS. 9 and 11 employ a common appliance in a plug-plug facing arrangement (roll of product with plug pivot at both ends), FIGS. 10 and 12 employ a common appliance in a core-core facing arrangement (roll of product with core pivot at both ends), FIG. 13 employs different appliances in a plug-plug facing arrangement, and FIG. 14 employs different appliances in a core-core facing arrangement. As will be appreciated from earlier discussions, other combinations of appliances 120, 125 are possible and contemplated, and all combinations of appliances 120, 125 in any orientation are considered within the scope of the invention disclosed herein.

Referring now back to FIGS. 2-6 collectively, each leg 130, 140 of appliances 120, 125 is flexible when the respective attachment feature 150 is rigidly fixed to the back plate 110 of the dispenser housing 105, thereby allowing outward flexing of the appliances 120, 125 to enable installation of a roll of product 300, 305 when the prior one is exhausted. To accommodate outward flexing, an embodiment includes a tab 220 disposed at a respective second end 132, 142, where the tab 220 is configured and sized so as to be engageable by a person's finger. The tab 220 is disposed at a distal end of the respective leg 130, 140 outboard of the respective roll holders 135, 136 and 145, 146. A suitable flexible material for appliances 120, 125 is a thermoplastic resin, which may or may not be reinforced with fiber for added strength.

Further description and illustration of the attachment feature 150 shows it to have a fixation portion 225 (see FIG. 5) having a length engageable with the back plate 110 of the dispenser housing 105 so as to form a cantilevered beam rigidly fixed at the fixation portion 225 when engaged with the dispenser housing 105. The attachment feature 150 further includes a stop surface 230 (see FIGS. 2 and 5) that limits a degree of engagement of the fixation portion 225 in the slot 165 of the back plate 110 of the dispenser housing 105.

As mentioned earlier, an alternative first end 131' (depicted in FIG. 6) to that of first end 131 (depicted in FIG. 3) and first end 141 (depicted in FIG. 5) may be employed to provide a snap-fit engagement of appliance 120, 125 to back plate 110. In the alternative embodiment, first end 131' includes two sideways compressible fingers 235 with latch details 240 that would latch onto suitably sized catches on back plate 110 in a manner similar to that discussed above in connection with latch 160 and catch 170. Any and all snap fit latches/catches suitable for the purpose disclosed herein are considered within the scope of the invention disclosed herein.

Another feature of the invention relates to the dimension D (see FIG. 5) from the pivot axis 210, 215 to the end of tab 220, which is sized to act as a measuring device. That is, when an "almost" used roll has an outside diameter flush with the end of the tab 220, the roll corresponds to a stub roll that can be removed and inserted into the bottom well of the dispenser. Stub rolls may vary in diameter, but typically have an outside diameter of less than 3-inches. Thus, dimension D of tab 220 would be sized according to the desired stub roll diameter.

From the foregoing, it will be appreciated that the scope of the invention encompasses any dispenser suitable for dispensing a rolled product, where the dispenser includes a housing having a back plate and a cover openably engaged with the back plate, and a pair of reversible and interchangeable roll holder appliances removably attached to the back plate, each appliance being oriented with associated roll holders facing each other and suitably spaced apart so as to receive the rolled product therebetween, where the rolled product can be of varied width.

The scope of the invention also includes a first combination of the pair of roll holder appliances, when in a first installed orientation, having a spaced-apart distance suitable to hold and dispense product from the rolled product having a first width dimension, and the first combination of the pair of roll holder appliances, when in a second installed orientation with at least one of the appliances being reversed in orientation with respect to the first installed orientation, having a spaced-apart distance suitable to hold and dispense product from the rolled product having a second width dimension different from the first width dimension.

The scope of the invention further includes a second combination of the pair of roll holder appliances, different from the first combination and when in a third installed orientation, having a spaced-apart distance suitable to hold and dispense product from the rolled product having a third width dimension different from the first and second width dimensions, and the second combination of the pair of roll holder appliances, when in a fourth installed orientation with at least one of the appliances being reversed in orientation with respect to the third installed orientation, having a spaced-apart distance suitable to hold and dispense product from the rolled product having a fourth width dimension different from the first, second and third width dimensions.

The scope of the invention yet further includes a dispenser arrangement where a pair of roll holder appliances in a first installed orientation include roll holders adapted, configured and dimensioned so as to engage an axial opening of a coreless roll of product, and where the pair of roll holder appliances in a second installed orientation different from the first installed orientation include roll holders adapted, configured and dimensioned so as to engage a pivot plug inserted into an axial opening of a careless roll of product.

While certain combinations of roll holders have been described herein, it will be appreciated that these certain combinations are for illustration purposes only and that any combination of any of the roll holders disclosed herein may be employed in accordance with an embodiment of the invention. Any and all such combinations are contemplated herein and are considered within the scope of the invention disclosed herein.

As disclosed, some embodiments of the invention may include some of the following advantages: interchangeable roll holders for a dispenser; reversible roll holders for a dispense; roll holder combinations adaptable in a dispenser to dispense rolls of product having different widths; and, roll holder combinations adaptable in a dispenser to dispense rolls with coreless pivots or with insertable core plugs for pivots.

The particular and innovative arrangement of roll holders on roll holder appliances according to the invention therefore affords numerous not insignificant technical advantages in addition to an entirely novel dispensing and dispenser maintenance arrangement.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best or only mode contemplated for carrying out this invention, but that the invention will include all embodiments falling within the scope of the appended claims. Also, in the drawings and the description, there have been disclosed exemplary embodiments of the invention and, although specific terms may have been employed, they are unless otherwise stated used in a generic and descriptive sense only and not for purposes of limitation, the scope of the invention therefore not being so limited. Moreover, the use of the terms first, second, etc. do not denote any order or importance, but rather the terms first, second, etc. are used to distinguish one element from another. Furthermore, the use of the terms a, an, etc. do not denote a limitation of quantity, but rather denote the presence of at least one of the referenced item.

What is claimed is:

1. A dispenser comprising:

a first leg comprising a first roll holder and a second roll holder positioned at a first leg first end, and a first attachment feature positioned at a first leg second end, wherein the first roll holder is positioned on a first leg first side and the second roll holder is positioned on a first leg second side; and a second leg comprising a third roll holder and a fourth roll holder positioned at a second leg first end, and a second attachment feature positioned at a second leg second end, wherein the third roll holder is positioned on a second leg first side and the fourth roll holder is positioned on a second leg second side;

wherein:

the first roll holder, the second roll holder, the third roll holder, and the fourth roll holder each have a different configuration than the other roll holders;

the first leg is attached to the dispenser with the first attachment feature and the second leg is attached to the dispenser with the second attachment feature;

the first leg and the second leg are positioned spaced apart such that one of the roll holders of the first leg is facing one of the roll holders on the second leg;

the first leg is reversible and interchangeable with respect to the second leg; and the first leg and the second leg are configured to support a sheet product roll positioned in between the first leg and the second leg and engaged with one of the first roll holder or the second roll holder of the first leg and one of the third roll holder or fourth roll holder of the second leg, such that the sheet product roll is supported by two different roll holders.

2. The dispenser of claim 1, wherein the first roll holder and the second roll holder are fixed relative to the first leg, and the third roll holder and the fourth roll holder are fixed relative to the second leg.

3. The dispenser of claim 1, wherein:

the first roll holder comprises a substantially cylindrical member extending from the first leg, the substantially cylindrical member comprising a cam projection extending along an outer surface of the substantially cylindrical member, wherein the substantially cylindrical member is hollow.

4. The dispenser of claim 1, wherein:

the second roll holder comprises:

a first surface and a ramp extending from the first leg, wherein the ramp extends from the first leg to an end of the first surface; and a cutout portion along a length of the first surface adjacent to an intersection between the ramp and the first surface.

5. The dispenser of claim 1, wherein:

the third roll holder comprises a hollow cylindrical member extending from the second leg, the hollow cylindrical member comprising a first diameter at a first portion adjacent to the second leg, and a second diameter at a second portion adjacent to the first portion, wherein the second diameter is less than the first diameter.

6. The dispenser of claim 1, wherein:

the fourth roll holder comprises:

a ramp portion extending from the second leg;

a cylindrical portion extending from the second leg and positioned adjacent to the ramp portion; and a planar portion extending from the second leg and positioned adjacent to the cylindrical portion.

7. The appliance of claim 1, wherein the attachment feature comprises a flexible finger comprising a snap fit locking detail.

8. The appliance of claim 1, wherein:

the first leg defines a medial line extending from the first leg first end to the first leg second end;

the first roll holder has a first pivot axis that extends perpendicularly from the medial line, and the external pivotal surface extends from the medial line by a first distance; and the second roll holder has a second pivot axis that extends perpendicularly from the medial line, and the internal pivotal surface extends from the medial line by a second distance different from the first distance.

9. The appliance of claim 1, wherein the leg is a flexible leg when the attachment feature is rigidly fixed to a dispenser housing.

10. The appliance of claim 1, wherein:

the first leg second end further comprises a tab configured and sized so as to be engageable by a person's finger, the tab being at a distal end of the leg outboard of the first and second roll holders, the tab having an outside dimension indicative of a stub roll having a desired outside diameter.

11. The appliance of claim 1, wherein:

the attachment feature comprises a fixation portion having a length engageable with a dispenser housing so as to form a cantilevered beam rigidly fixed at the fixation portion when engaged with the dispenser housing; and the attachment feature further comprises a stop surface that limits a degree of engagement of the fixation portion to the dispenser housing.

* * * * *